United States Patent [19]

Brown

[11] 4,413,564

[45] Nov. 8, 1983

[54] SLUG FOR A SHOTGUN SHELL

[76] Inventor: Worthy H. Brown, R.D. 7, Box 60, Fulton, N.Y. 13069

[21] Appl. No.: 259,591

[22] Filed: May 1, 1981

[51] Int. Cl.[3] ..... F42B 13/24

[52] U.S. Cl. ..... 102/501; 102/439; 102/517; 244/3.23

[58] Field of Search ..... 102/430, 436, 439, 501, 102/517; 244/3.23, 3.21

[56] References Cited

U.S. PATENT DOCUMENTS

| | | | |
|---|---|---|---|
| 1,518,920 | 12/1924 | Halloran | 102/501 |
| 3,062,145 | 11/1962 | Morgan et al. | 102/439 X |
| 3,394,905 | 7/1968 | Rapp | 102/517 |
| 4,301,733 | 11/1981 | Blanco | 102/517 |

FOREIGN PATENT DOCUMENTS

| | | | |
|---|---|---|---|
| 665259 | 6/1965 | Belgium | 102/517 |
| 24314 | of 1902 | United Kingdom | 102/501 |
| 24432 | of 1904 | United Kingdom | 244/3.21 |
| 21522 | of 1910 | United Kingdom | 244/3.23 |

*Primary Examiner*—Harold J. Tudor
*Attorney, Agent, or Firm*—Bruns & Jenney

[57] ABSTRACT

A shotgun slug having a frusto-conical body that increases a diameter from front to rear and which further includes a plurality of vanes projecting radially from the body which extend obliquely along the length thereof. The top lands of the vanes describe a truncated cone that is axially aligned with the body and which provide an interference fit with the bore of the gun barrel. The pitch of the cone described by the vanes is steeper than that of the supporting body so that the height of the vanes decrease from front to rear. Sufficient radial depth is given to the vanes so that the vanes retain their shape after the slug has been swagged in the barrel during firing. Accordingly, a stabilizing spin is imparted to the slug as it moves through the air towards the target. The slug is further provided with a nose heavy geometry which further enhances its flight characteristics thereby improving both range and accuracy.

4 Claims, 5 Drawing Figures

SLUG FOR A SHOTGUN SHELL

BACKGROUND OF THE INVENTION

This invention relates to an improved shotgun slug and, in particular, to a shotgun slug having improved range and accuracy.

In many areas of the country the taking of some larger game, such as deer, is restricted to the use of shotguns. Accordingly, the hunter usually hunts with shells that are loaded with a single slug in place of shot. Historically, the use of slugs has proven to be unsatisfactory because of the limited range and general inaccuracy of this type of projectile.

Initially, slugs were made in various configurations with the outside diameter being slightly less than the bore of the barrel. The undersized slug, when fired, tended to bounce as it moved through the barrel and, as a consequence, its flight trajectory would invariably be slightly different from where the barrel was aimed. In an effort to improve the accuracy of slugs, newer projectiles were made cylindrical in form and grooves were cut into the side wall of the cylinder. The slug was also made slightly oversized so that it was swagged slightly as it moved through the barrel. The grooves permitted the slug to be radially deformed into centering conformity with the barrel during firing which improved accuracy somewhat. However, the flight characteristic of the grooved slug remained less than satisfactory.

As disclosed in U.S. Pat. No. 3,062,145, a vaned slug has been developed which provides for better flight stability. In this particular arrangement, the shell wadding is driven into locking engagement with the slug at the time of firing to increase the overall length of the projectile. The wad is pushed against the vanes with sufficient force to bend the back end of the vanes 90° in relation to the axis of the slug. Although locking the wadding to the slug may in effect length the projectile, it also gives rise to other problems which adversely affect its flight characteristics. Most wads are generally unsymmetrical and tend to come apart as they move through the barrel. As a consequence, the flight of the projectile may be rather unpredictable.

SUMMARY OF THE INVENTION

It is therefore an object of the present invention to improve the range and accuracy of a slug used in a shotgun shell.

It is a further object of the present invention to improve the flight characteristics of a slug used in a shotgun shell.

A still further object of the present invention is to provide a shotgun slug that contains radially extended vanes which impart a spin to the slug as it moves through the air.

Another object of the present invention is to provide a nose heavy shotgun slug having improved aerodynamic properties.

These and other objects of the present invention are attained by means of a shotgun slug having a truncated conical body that increases in diameter from front to rear and which further includes a plurality of vanes projected radially from the body that extend obliquely along the axial length of the body. The top lands of the body describe a truncated cone that is axially aligned with the body; the pitch of the cone being steeper than that of the body whereby the height of the vanes decreases from front to rear. The center of gravity of the slug is positioned well forward of its midplane to provide a nose heavy geometry to the slug.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 2:
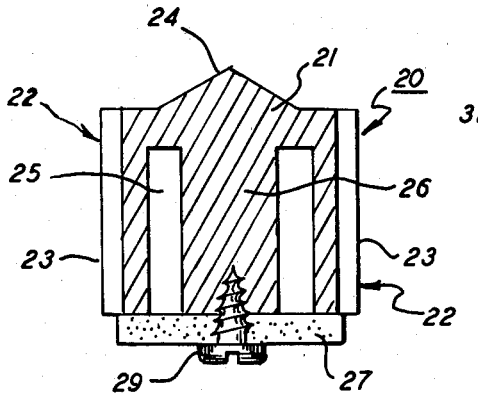
FIG. 2 (Prior Art)
FIG. 2 is also a sectional view illustrating the configuration of a slug used in the prior art.

Referring initially to FIG. 2, there is shown a sectional side view of a shotgun slug 20 that has been used in the art for some time. The slug is typically cast or otherwise formed from a single piece of lead to provide a cylindrical body section 21. A plurality of shallow vanes 22—22 project radially from the body. Typically the vanes are obliquely positioned in regard to the body and extend along the entire length thereof. The top lands 23—13 of the vanes describe a cylinder which is axially aligned with the body section. An extremely flat pointed nose 24 is mounted upon the front face of the body to facilitate penetration when the slug strikes a target. The inside of the slug body contains a generally hollow chamber 25 in which is centered a mounting post 26. A charge card 27, which can be of the same diameter or larger than the body 21, is secured to the rear face of the post by a screw 29 whereby the card forms an integral part of the projectile.

The outside diameter of the vanes contained in the prior art slug is sized larger than the bore of the shotgun barrel from which it is fired. Accordingly, the vanes are swagged inwardly as the slug transverses the barrel. In practice, the vanes are almost totally expanded laterally into the shallow spaces therebetween. The swagged slug leaving the barrel has a relativey smooth body and little spin is thus imparted to the slug as it moves towards the target. By the same token, the charge card secured to the rear of the slug oftentimes becomes deformed or crimped during firing and acts as an uncontrollable airfoil which makes the flight of the projectile unpredictable.

Figure 5:
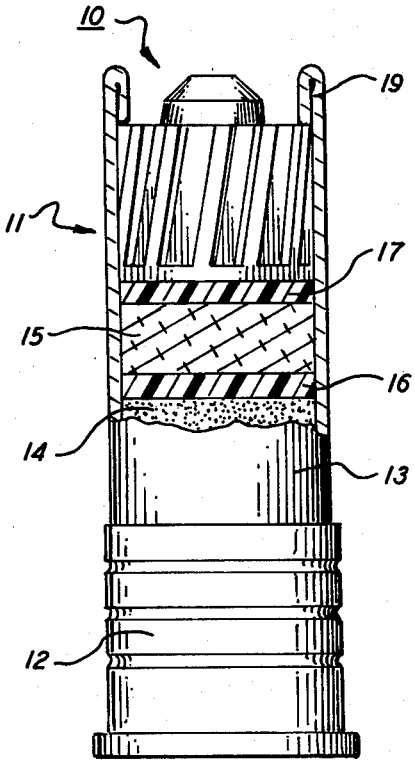
FIG. 5 is a side elevation with sections broken away illustrating the slug of the present invention loaded in a shotgun shell.

As best seen in FIG. 5, in the illustrative embodiment of the invention, a shotgun slug 10, which embodies the teachings of the present invention is adapted for use in a conventional shotgun shell denoted at 11. This shell contains a cylindrical metal base 12 and an elongated paper board casing 13 mounted therein. It should be noted that the casing can be formed of plastic or other similar materials known and used in the art. A priming cap (not shown) is centered at the bottom of the base which, when struck, ignites the contained gunpowder. Mounted in the casing in front of the powder chamber 14 is a filler wad 15 that is sandwiched between a plastic disc 16 and a conventional charge card 17. The slug is placed in the casing in a normal manner with the rear face of the slug seated against the charge card. In this case the forward edge of the shell casing is roll crimped as shown at 19 to hold the slug against the charge card with a suitable degree of pressure.

Figure 3:
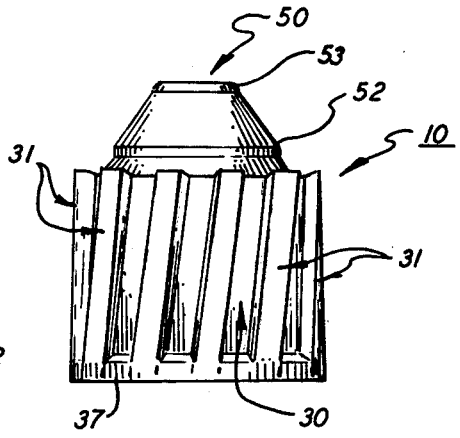
FIG. 3 is a side elevation of the slug shown in FIG. 1 better illustrating the oblique vanes projecting from the body thereof.
Figure 4:
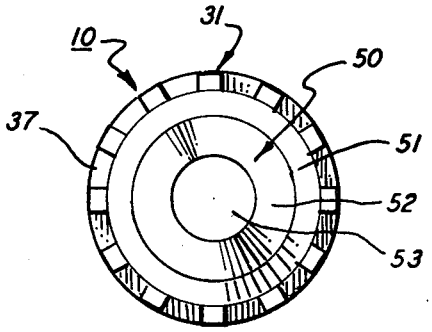
FIG. 4 is a top view of the slug shown in FIG. 3.
Figure 1:
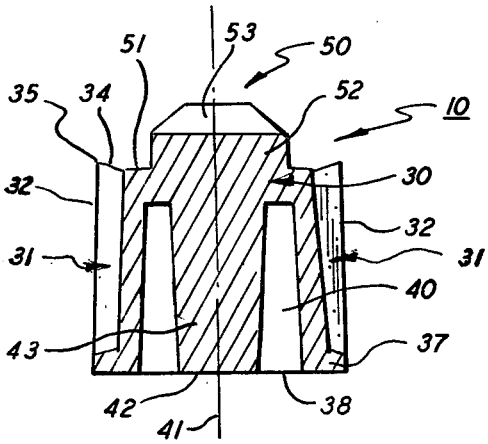
FIG. 1 is an enlarged sectional view taken through the axis of a shotgun slug embodying the teachings of the present invention.

Referring now more specifically to FIGS. 1, 3 and 4, there is shown a slug embodying the teachings of the present invention which is preferably made of lead or any other material used in the art. The slug includes a truncated conical body 30 which is of increasing diameter from front to rear. A plurality of equally spaced vanes 31—31 project radially from the body. The vanes are obliquely positioned in regard to the axis 41 of the slug and extend axially along the length of the body.

The top lands 32—32 of the vanes combine to describe a truncated cone which is co-axially aligned with the body of the slug. The pitch of the cone described by the vane lands is steeper than that of the body section so that the radial depth of the vanes decreases from front to rear. Each vane has a front shoulder 34 that extends beyond the front face of the body and which slopes inwardly toward the center of the slug to provide a cutting edge 35 along the outer periphery thereof. Each vane is a straight fluted member extending between the front face and rear face of the body. The vanes are generally rectangular shaped in cross section with the base of the vane at the body wall being slightly wider than the top surface 32 which describes the outer periphery of the slug. A slope of about 7° is given to both side walls. An annular ring 37 (FIG. 3), which is a depending part of the body, projects outwardly from the bottom edge of the body. The bottom surface of the ring is coplanar with the end face 39 of the slug. The back shoulder of each vane blends into the ring whereby the ring forms the base of the cone described by the vanes.

A blind tapered hole 40 is passed into the body of the slug from the rear end face 38 with the hole being centered on the axis 41 of the slug. The hole is brought to a depth that is beyond the midplane of the body so that the axial depth of the blind hole is greater than one half the axial length of the body 30, thereby considerably lightening the rear section thereof. A post 43 is centered within the blind hole. The end face 42 of the post is perpendicular to the axis of the slug and is coplanar with the slug end face. The end of the post coacts with the end face of the slug to provide a secure surface against which the charge card may effectively react during firing.

A nose 50 projects outwardly from the front face 51 of the body. The nose includes a cylindrical base 52 and a slightly concave impact head 53 supported upon the base. The head is designed to mushroom upon impact to increase the slug's striking power. The knife-edges 35 on the vanes on the other hand facilitate entry of the slug into the target. The extended nose section also provides added weight to the front of the slug to further enhance its nose heavy characteristic.

In practice, the pitch of the side wall of the body section is about 2° as measured with the axis 41 of the slug while the top lands of the vanes form an angle of about ½° when measured against the same axis. The outside diameter over the lands at the front of the slug is slightly larger than the bore of a fully choked gun barrel. Accordingly, the vanes will be deformed or swagged as the slug passes through the barrel. This prevents the slug from "bouncing" in the barrel and holds it centered as it moves along the barrel. Sufficient height is given to the vanes to accommodate swagging without the slug losing its vaned geometry. As a result, the canted vanes are able to catch the air as the slug moves towards the target and causes the slug to spin about its axis while in flight. This spinning effect coupled with the nose heavy attitude of the slug and its clean outer configuration provide the slug with excellent flight characteristics when compared to any other slug now in use. It has been found that by offsetting the vanes at an angle of about 7°–10° with the axis of the slug provides for excellent slug rotation.

In tests made with slugs made in accordance with this invention, it has been shown that the slug will derive greater accuracy over longer ranges than any presently available slugs now on the market. The present slug drops about 2" in 100 yards which is considerably better than most conventional slugs which drop about 10" in the same distance. Tight groups were also consistently shot at 100 yards or better with the grouping averaging considerably less than conventional slugs fired at the same distance.

It is believed the extreme accuracy of the present slug at relatively long range is among other things attributable to its ability to be slightly swagged in the barrel while at the same time preserving the vanes' air holding ability. As noted, the space or grooves between the vanes form a converging nozzle in relation to the incoming air to compact the air as it moves toward the rear of the slug. The back of each groove is also closed off by the annular ring which further enhances the compacting effect. As a result a turbine effect is realized as the air attempts to spill over the vanes thereby turning the slug about its axis as it travels toward the target. It has been found that the height of the straight fluted vanes as measured radially from the outer surface of the base to the top of the lands 32 should preferably be about four times the amount of interference provided between the bore of the shotgun and the outer periphery of the slug that is normally allowed for swagging. Accordingly, the vanes can be deformed or swagged into the channels between the vanes without adversely altering the slug's ability to rotate as it moves through the air.

While this invention has been described with reference to the details as set forth above, it is not limited to the specific structure as disclosed and the invention is intended to cover any modifications or changes as may come within the scope of the following claims.

I claim:

1. A slug cast from a single piece of metal for use in a smooth bore shotgun, said slug comprising a truncated conical body having a flat circular front face and a parallelly disposed flat rear face, the diameter of the front face being slightly less than the diameter of the rear face, a series of circumferentially spaced, straight, fluted, rectangular shaped vanes projecting outwardly from the side wall of the body with the vanes being separated by channels, each vane extending obliquely between the front face and the rear face of the body with the top surfaces of the vanes describing a truncated cone, the pitch of the truncated cone of the vanes being steeper than the pitch of the truncated cone of said truncated conical body whereby the height of the vanes decreases from the front face to the rear face of the slug, said vanes move in interfering contact against the bore of the shotgun to impart a rotational motion to the slug as it moves therethrough, each vane further having a front tip that extends outwardly from the front face of said body and which terminates in a chisel point edge, a blunt nose projecting forwardly from the front face of said body a greater distance than the chisel point edges on said vanes whereby the nose strikes a target before said chisel point edges, an annular ring at the rear face of the body that has an outer diameter substantially equal to the outside diameter of the cylinder described by the vanes whereby the ring closes each channel between the vanes, and said body containing a blind hole passing inwardly from the rear face to a depth that is greater than one-half the axial length of the body whereby the slug has a nose heavy configuration.

2. The slug of claim 1 that further includes a post axially aligned within said blind hole that has a distal end lying in the plane of the rear end face of the body.

3. The slug of claim 1 wherein the straight fluted vanes of the slug form an angle of between 7° and 10° with a diametrical plane of the slug whereby the metal slug can be easily removed from a casting mold.

4. The slug of claim 1 wherein the outside diameter over the vanes is larger than the bore of the shotgun by an amount about equal to one-fourth the depth of the channels.

* * * * *